US006523687B2

(12) United States Patent
Ling

(10) Patent No.: US 6,523,687 B2
(45) Date of Patent: Feb. 25, 2003

(54) TOOLBOX WITH DUAL TOOL-RECEIVING GROOVES AND DISPLAY IN BOTH SIDES THEREOF

(75) Inventor: David Ling, Taichung (TW)

(73) Assignee: Hand Tool Design Corporation, Christiana, DE (US)

( * ) Notice: Subject to any disclaimer, the term of this patent is extended or adjusted under 35 U.S.C. 154(b) by 0 days.

(21) Appl. No.: 09/803,638

(22) Filed: Mar. 9, 2001

(65) Prior Publication Data

US 2002/0117413 A1 Aug. 29, 2002

(51) Int. Cl.[7] ..... B65D 85/18
(52) U.S. Cl. ..... 206/378; 206/373; 206/777
(58) Field of Search ..... 206/523, 372, 206/373, 376, 377, 378, 775, 776, 777, 778, 782; 220/528, 761

(56) References Cited

U.S. PATENT DOCUMENTS 3,311,231 A * 3/1967 English, Jr. ..... 206/523
4,311,222 A * 1/1982 Castanier ..... 190/18 A
4,927,024 A * 5/1990 Lloyd ..... 206/562
5,398,810 A * 3/1995 Yao Wang ..... 206/371
D367,360 S * 2/1996 Wolff ..... D3/201
5,524,915 A * 6/1996 Liu ..... 206/372
5,526,929 A * 6/1996 Wei ..... 206/372
5,570,784 A * 11/1996 Sidabras et al. ..... 206/378
5,788,072 A * 8/1998 Chen ..... 206/372
5,915,554 A * 6/1999 Hung ..... 206/372
6,131,740 A * 10/2000 Huang ..... 206/372
6,206,189 B1 * 3/2001 Huot et al. ..... 206/379
6,213,296 B1 * 4/2001 Streich et al. ..... 206/373
6,260,700 B1 * 7/2001 Huang ..... 206/372
6,371,290 B1 * 4/2002 Yearous et al. ..... 206/278
D458,840 S * 6/2002 Lai ..... D9/418
D459,223 S * 6/2002 Lai ..... D9/418

* cited by examiner

*Primary Examiner*—Shian Luong
(74) *Attorney, Agent, or Firm*—Nelson Mullins Riley & Scarborough, LLP

(57) ABSTRACT

A toolbox has a tool-receiving plate received therein. The tool-receiving plate includes a number of tool-receiving grooves in both sides thereof. The toolbox includes a first casing and a second casing that is pivotally connected to the first casing at one end thereof. Each of the first and second casings has an opening for viewing and displaying purposes. Glass is fitted in each opening to avoid theft.

14 Claims, 6 Drawing Sheets

TOOLBOX WITH DUAL TOOL-RECEIVING GROOVES AND DISPLAY IN BOTH SIDES THEREOF

BACKGROUND OF THE INVENTION

1. Field of the Invention

The present invention relates to a toolbox, and more particularly to a toolbox with a tool-receiving plate having tool-receiving grooves defined in both sides thereof. The toolbox further includes a glass in each of two casings thereof for displaying purposes.

2. Description of the Related Art

A toolbox may receive tools of various sizes for repair and maintenance purposes. It is common to put various kinds of tools, such as screwdrivers, pliers, hammers, socket wrenches, etc. in a toolbox that has a certain receiving space. As a result, it takes time for the user to find the desired tool. A further drawback to the user is that a toolbox that receives all kinds of tools of various sizes is relatively large and thus inconvenient to carry. In addition, the user cannot know whether any tool is lost, as the toolbox is not transparent, which also fails to attract the customers.

SUMMARY OF THE INVENTION

It is the primary object of the present invention to provide an improved toolbox having a tool-receiving plate received therein. The tool-receiving plate includes a plurality of tool-receiving grooves in both sides thereof. In addition, the toolbox includes a first casing and a second casing that is pivotally connected to the first casing at one end thereof. Each of the first and second casings has an opening for viewing and displaying purposes. Glass is fitted in each opening to avoid theft.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
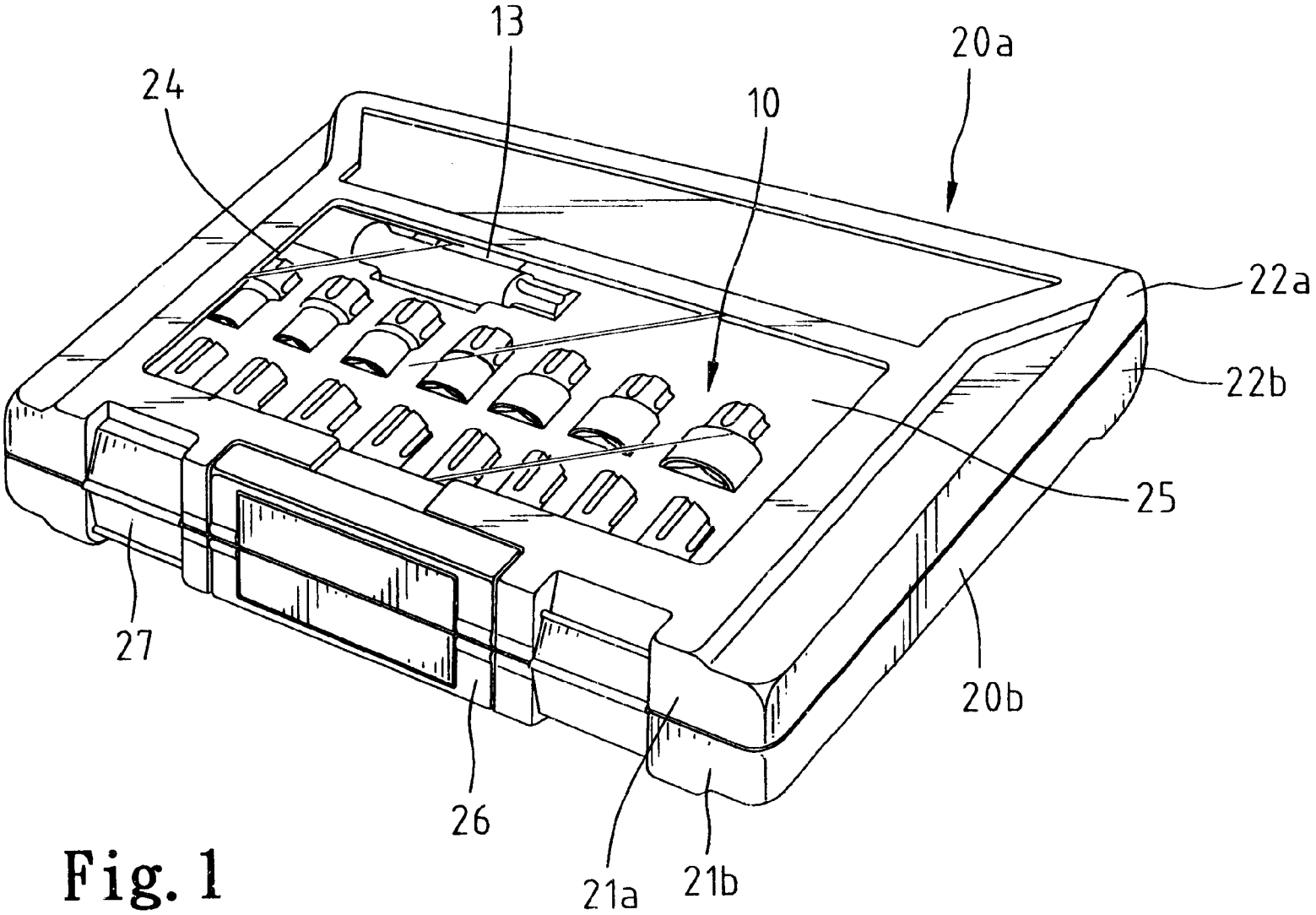
FIG. 1 is a perspective view of a toolbox in accordance with the present invention.
Figure 2:
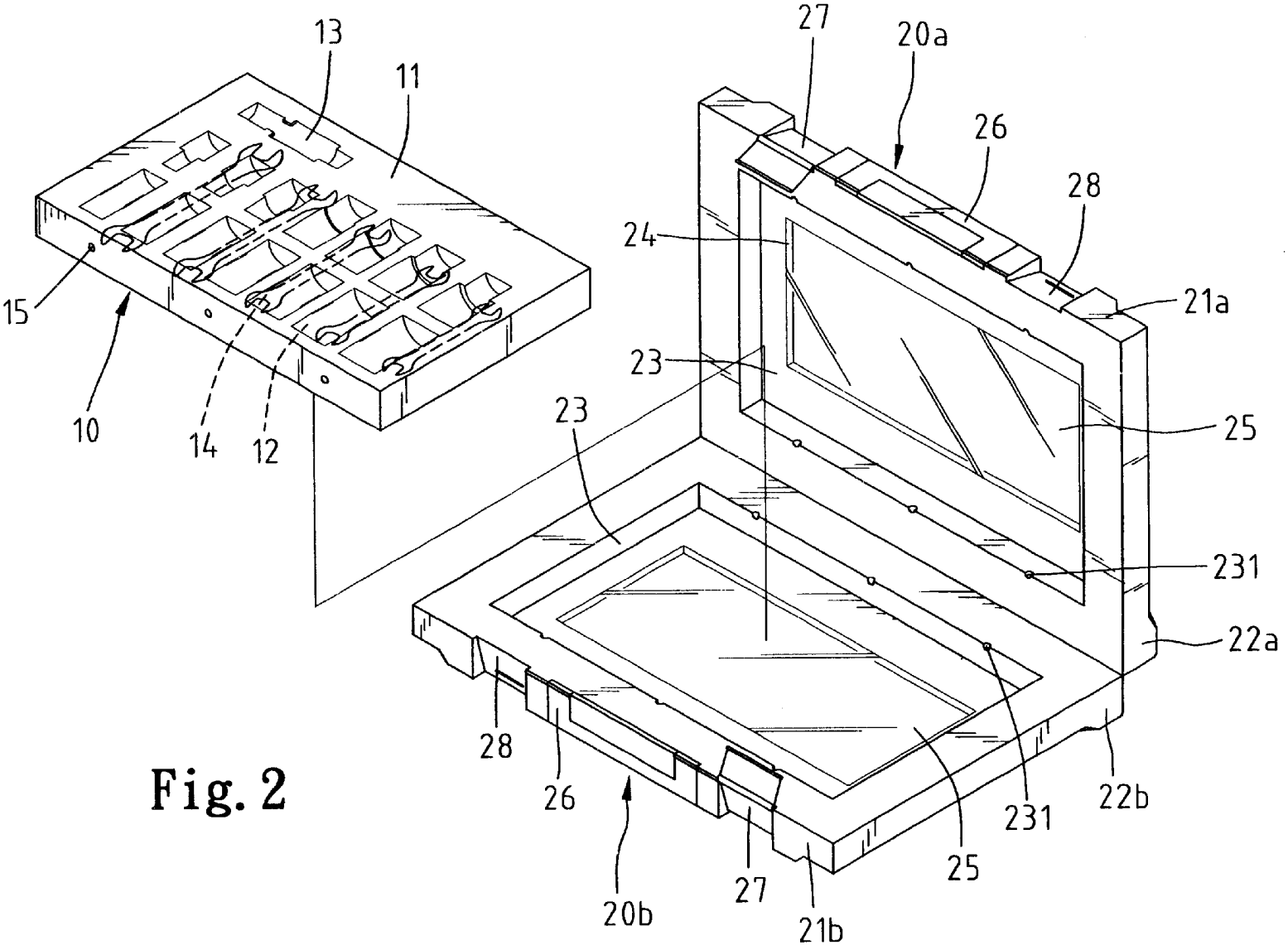
FIG. 2 is an exploded perspective view of the toolbox in accordance with the present invention.
Figure 3:
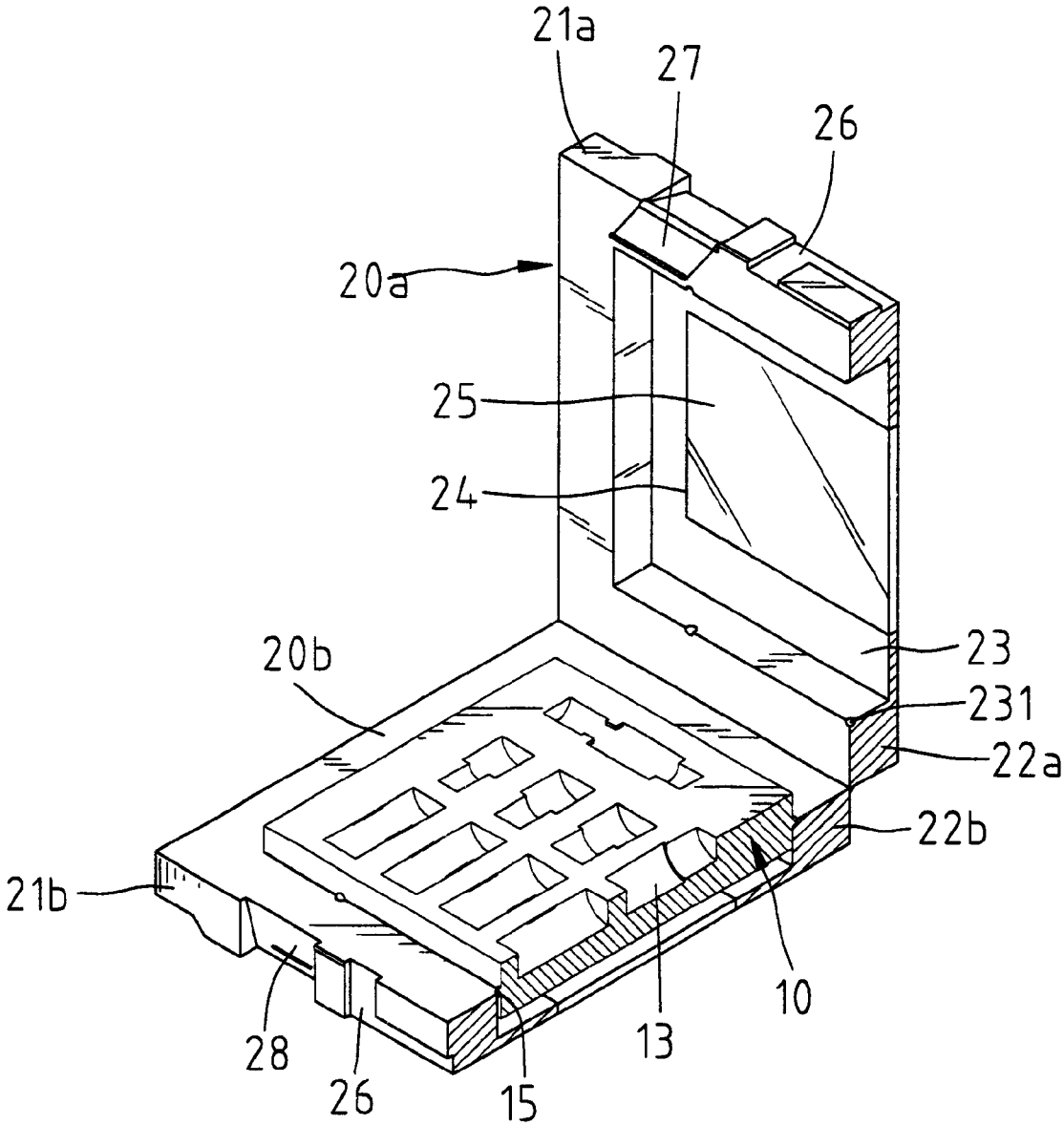
FIG. 3 is a perspective view, partly cutaway, of the toolbox in accordance with the present invention.
Figure 4:
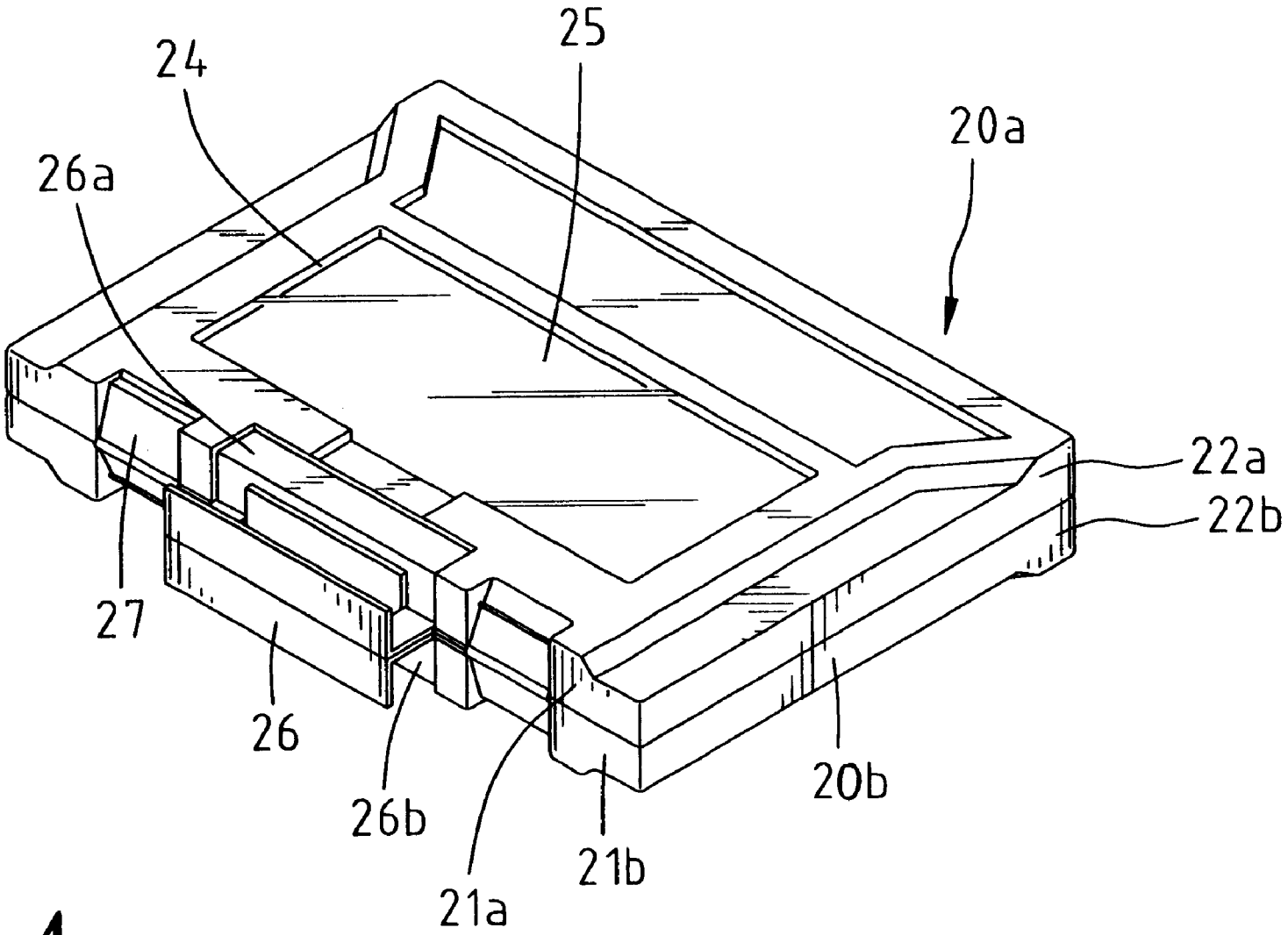
FIG. 4 is a perspective view of the toolbox in accordance with the prevent invention, wherein the handle of each casing of the toolbox is in an operative position.

Referring to FIGS. 1 through 3, a toolbox in accordance with the present invention generally includes a first casing 20*a,* a second casing 20*b,* and a tool-receiving plate 10. The first casing 20*a* includes a first side 22*a* pivotally connected to a first side 22*b* of the second casing 20*b*. A second side 21*a* of the first casing 20*a* is releasably engaged with the second side 21*b* of the second casing 20*b*. In this embodiment, the second side 21*a* of the first casing 20*a* includes a male engaging member 27 and a female engaging member 28 and the second side 21*b* of the second casing 20*b* includes a female engaging member 28 and a male engaging member 27 for releasably engaging with the male engaging member 27 and the female engaging member 28 of the first casing 20*a,* respectively. As illustrated in FIG. 4, each casing 20*a,* 20*b* further includes a handle 26 pivotally mounted to the second side 21*a,* 21*b* that has a recessed section 26*a,* 26*b*. When the toolbox is to be carried, the handle 26 is pivoted to an operative position shown in FIG. 4. When the toolbox is to be opened, each handle 26 is received in the recessed section 26*a,* 26*b* of an associated casing 20*a,* 20*b* (FIG. 1).

Each casing 20*a,* 20*b* further includes a receiving space 23 defined in an inner side thereof. An opening 24 is defined in each casing 20*a,* 20*b* and communicates with the receiving space 23 for viewing and displaying purposes. Glass 25 is mounted in each opening 24 for preventing theft. In addition, a periphery defining the receiving space 23 includes a plurality of notches 231.

Figure 6:
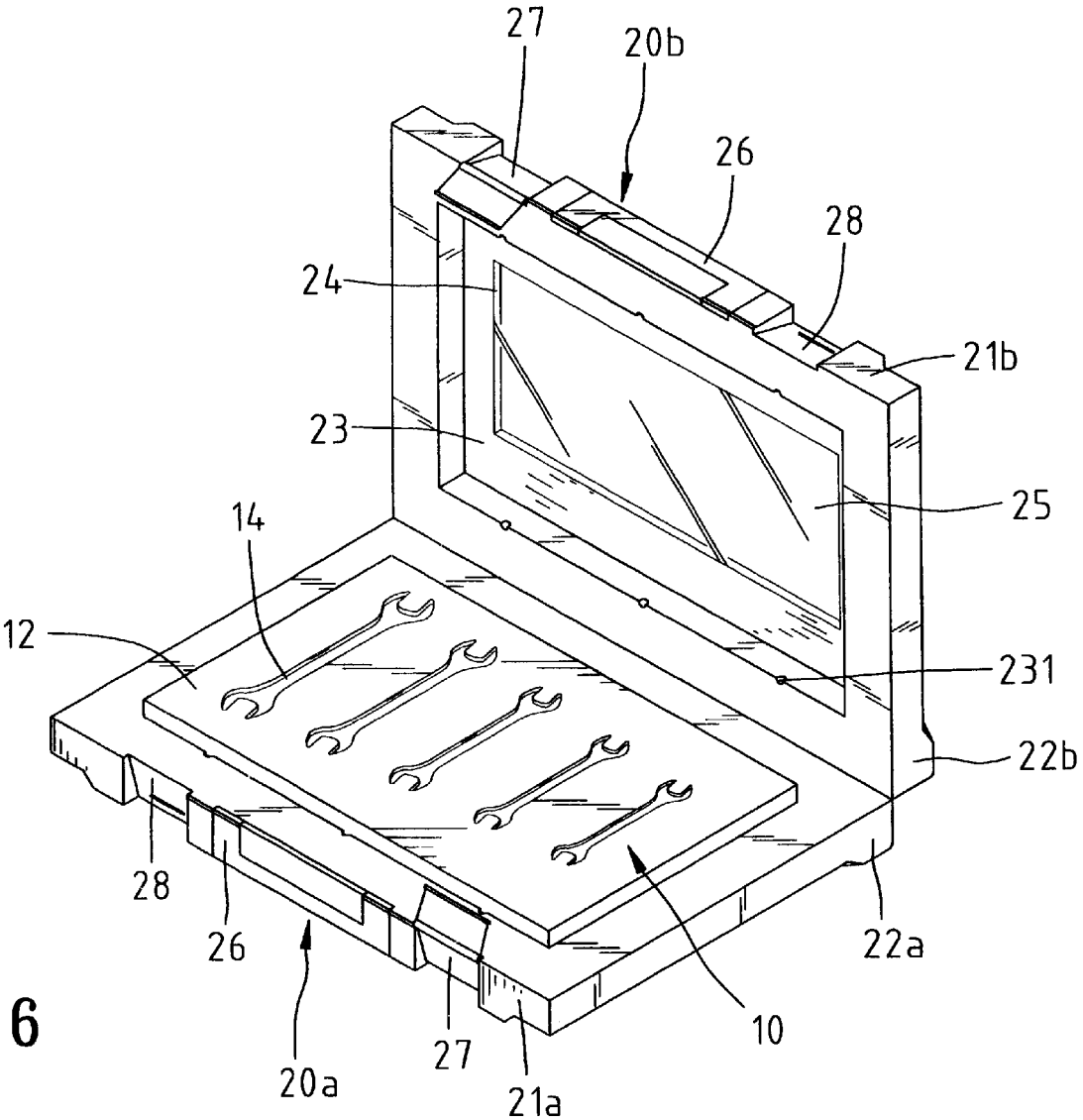
FIG. 6 is a perspective view similar to FIG. 5, illustrating the other side of a tool-receiving plate in the toolbox.

Still referring to FIGS. 1 through 3, the tool-receiving plate 10 includes an upper side 11 and an underside 12, wherein the upper side 11 includes a plurality of tool-receiving grooves 13 for receiving, e.g., sockets (FIG. 1), and the underside 12 includes a plurality of tool-receiving grooves 14 for receiving, e.g., spanners (FIG. 6). The tool-receiving plate 10 includes a plurality of knurls 15 on each of two opposite longitudinal sides thereof.

Referring to FIG. 3, when the toolbox is opened, the tool-receiving plate 10 is received in one of the receiving spaces 23 of the casings 20*a* and 20*b* with the knurls 15 on one of the longitudinal sides of the tool-receiving plate 10 engaging with the associated notches 231. This retains the tool-receiving plate 10 in place. When the toolbox is closed, the tool-receiving plate 10 is received in both of the receiving spaces 23 of the casings 20*a* and 20*b* with the knurls 15 on both of the lateral sides of the tool-receiving plate 10 engaging with the associated notches 231.

Figure 5:
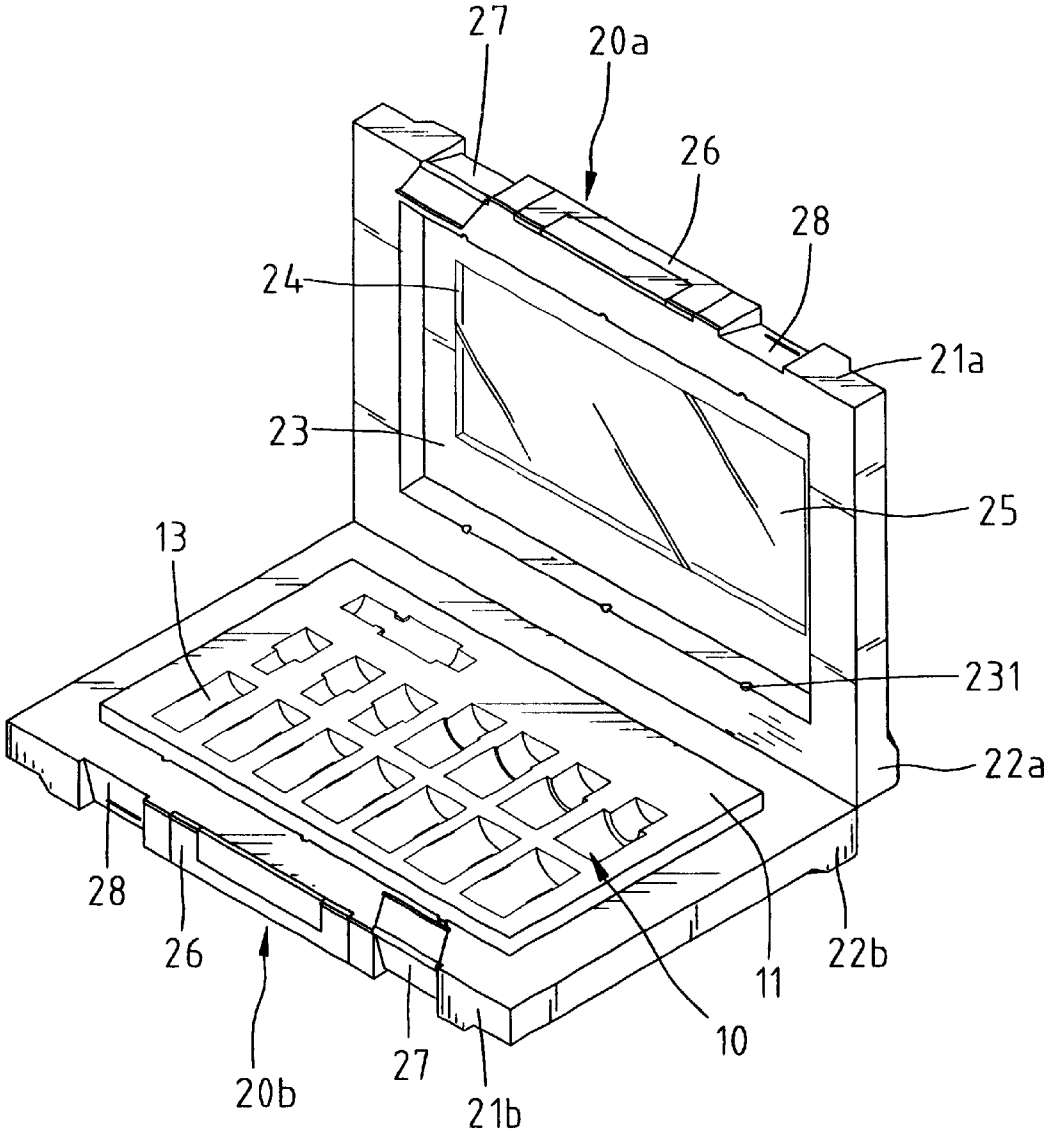
FIG. 5 is a perspective view of the toolbox in accordance with the present invention, wherein the handle of each casing is in a storage position.

As illustrated in FIG. 1, the user may clearly view the tools in the upper side 11 of the tool-receiving plate 10. The toolbox can be opened for use, as illustrated in FIG. 5. Referring to FIG. 6, the user may also clearly view and use the tools in the underside 12 of the tool-receiving plate 10 by means of turning the toolbox upside-down.

According to the above description, it is appreciated that the toolbox in accordance with the present invention may receive more tools of various kinds and sizes in a limited space. The handles of the casings of the toolbox can be moved to their storage positions when not in use or for transport purposes. The handles can be moved to the operative positions for easy carriage to the user. The user may clearly view the tools on both sides of the tool-receiving plate to check if any one of the tools is lost. This may also attract potential customers. In addition, the glass may prevent theft.

Although the invention has been explained in relation to its preferred embodiment, it is to be understood that many other possible modifications and variations can be made without departing from the scope of the invention as hereinafter claimed.

What is claimed is:

1. A toolbox comprising:

first casing including a window defined therein, a first side and a second side;

a second casing including a window defined therein, a first side pivotally connected to the first side of the first casing and a second side releasably engaged with the second side of the first casing, the first casing and the second casing together defining a receiving space;

a tool-receiving plate received in the receiving space, the tool-receiving plate including a first face and a second face, each of the first and second faces including a plurality of tool-receiving grooves;

a first display element mounted on the first casing so as to cover the window defined in the first casing and allow visual inspection of tools carried on the first face of the tool-receiving plate; and a second display element mounted on the second casing so as to cover the window defined in the second casing and allow visual inspection of tools carried on the second face of the tool-receiving plate.

2. The toolbox as claimed in claim 1, wherein the second side of each of the first casing and the second casing includes a recessed section, further comprising a handle pivotally mounted in the second side of each of the first casing and the second casing, each said handle being received in an associated said recessed section when not in use.

3. The toolbox as claimed in claim 1, wherein said receiving space is defined in each of the first casing and the second casing.

4. The toolbox as claimed in claim 1, wherein a periphery defining the receiving space includes a plurality of notches, the tool-receiving plate including a plurality of knurls for engaging with the notches.

5. The toolbox as claimed in claim 1, wherein the second side of the first casing includes a male engaging member and the second side of the second casing includes a female engaging member for engaging with the male engaging member formed on the second side of the first casing.

6. The toolbox as claimed in claim 1, wherein the second side of the first casing includes a male engaging member and a female engaging member, and wherein the second side of the second casing includes a female engaging member and a male engaging member for engaging with the male engaging member and the female engaging member of the first casing, respectively.

7. The toolbox as claimed in claim 1, wherein the tool-receiving grooves in the first side of the tool-receiving plate are different from the tool-receiving grooves in the second side of the tool-receiving plate.

8. The toolbox according to claim 1 wherein the first display element is a transparent panel.

9. The toolbox according to claim 8 wherein the transparent panel is made of glass.

10. The toolbox according to claim 1 wherein the second display element is a transparent panel.

11. The toolbox according to claim 10 wherein the transparent panel is made of glass.

12. A toolbox comprising:

first casing having a first side, a second side and a first receiving space;

a second casing having a first side, a second side and a second receiving space, the first side of the first casing and the first side of the second casing being pivotally connected and the second side of the first casing releasably engaging the second side of the second casing in a closed position, the first receiving space and the second receiving space defining a plate receiving space in the closed position, and the first casing and the second casing having a first open position and a second open position;

a tool receiving plate having a first side and a second side, the tool receiving plate disposed within the plate receiving space, with the tool receiving plate located outside of the first casing and being received in the second casing and tools received in the first side being accessible in the first open position and the tool receiving plate located outside the second casing and being received in the first casing and the tools received in the second side being accessible in the second open position.

13. The toolbox according to claim 12 with the first open position accomplished by releasing and moving the first casing from a generally horizontal position to a generally vertical position and the second open position accomplished by releasing and moving the second casing from a generally horizontal position to a generally vertical position.

14. The toolbox according to claim 12 further comprising, in combination:

a window defined in the first casing;

a first display element mounted on the first casing so as to cover the window defined in the first casing and allow visual inspection of tools carried on the first face of the tool-receiving plate;

a window defined in the second casing; and a second display element mounted on the second casing so as to cover the window defined in the second casing and allow visual inspection of tools carried on the second face of the tool-receiving plate.

* * * * *